US006231258B1

(12) United States Patent
Kingsley

(10) Patent No.: US 6,231,258 B1
(45) Date of Patent: May 15, 2001

(54) JEWELRY CLEANING APPARATUS

(75) Inventor: Charles E. Kingsley, Bannockburn, IL (US)

(73) Assignee: Kingsley & Associates, Inc., Deerfield, IL (US)

( * ) Notice: Subject to any disclaimer, the term of this patent is extended or adjusted under 35 U.S.C. 154(b) by 0 days.

(21) Appl. No.: 09/044,489

(22) Filed: Mar. 19, 1998

Related U.S. Application Data

(60) Provisional application No. 60/041,316, filed on Mar. 19, 1997.

(51) Int. Cl.[7] ..... A47B 11/02
(52) U.S. Cl. ..... 401/123; 401/137
(58) Field of Search ..... 401/25, 26, 37, 401/39, 52, 137, 139, 123; 359/809

(56) References Cited

U.S. PATENT DOCUMENTS

| | | | | |
|---|---|---|---|---|
| 864,676 | * | 8/1907 | Nagely | 401/137 |
| 1,766,990 | * | 6/1930 | Freeman | 401/52 |
| 2,236,240 | * | 3/1941 | Lowen | 401/123 |
| 2,563,315 | * | 8/1951 | Den Uyl | 359/809 |
| 2,617,409 | * | 11/1952 | Biederman | 359/809 |
| 2,961,108 | * | 11/1960 | Johnson | 359/809 |
| 3,052,910 | * | 9/1962 | Kushner | 401/25 |
| 3,516,424 | * | 6/1970 | Eagle | 401/137 |
| 4,602,846 | * | 7/1986 | Karnes | 401/52 |
| 4,768,531 | * | 9/1988 | Broussard | 401/52 |
| 5,299,876 | * | 4/1994 | Singarella | 401/137 |
| 5,558,453 | * | 9/1996 | Bell et al. | 401/139 |

FOREIGN PATENT DOCUMENTS

| | | | | |
|---|---|---|---|---|
| 1283930 | * | 8/1972 | (GB) | 401/190 |

* cited by examiner

*Primary Examiner*—Charles A. Eloshway
(74) *Attorney, Agent, or Firm*—Fitch, Even, Tabin & Flannery

(57) ABSTRACT

A small, compact jewelry cleaning apparatus is provided that easily fits into a pocket, purse, or travel bag, to allow a user to clean jewelry conveniently and thoroughly either at or away from home. The preferred apparatus includes a small container containing a reservoir of cleaning fluid, a cleaning instrument, which preferably is attached to the container, and a magnifying lens, also preferably attached to the container. The preferred method for cleaning jewelry using the apparatus involves applying cleaning fluid contained in the container to a piece of jewelry, removing foreign matter from the jewelry using the cleaning instrument, drying the jewelry, and inspecting the jewelry using the magnifying lens. Any of these steps may be repeated as necessary.

8 Claims, 6 Drawing Sheets

100
110
112
114
116
118
120
122
130
134
136
138
140
142
144
146
148
152
174

JEWELRY CLEANING APPARATUS

RELATED APPLICATION

This application is based on, and claims benefit of, U.S. Provisional Application Serial No. 60/041,316 filed Mar. 19, 1997.

BACKGROUND OF THE INVENTION

The present invention relates generally to an apparatus and a method for cleaning jewelry, and more particularly, to a small cleaning kit that can be carried in a pocket, purse or travel bag.

It is well known to use a jewelry cleaning fluid to clean various types of jewelry. One jewelry cleaning apparatus available to consumers includes a jar of solution, a removable tray, and a small brush. Items of jewelry are placed on the tray and submerged in cleaning fluid inside the jar. Jewelry may be either dipped or soaked, depending on the extent of foreign matter accumulated on the jewelry, brushed clean using the accompanying brush, and then rinsed in fresh water.

Although such a cleaning apparatus is suitable for home use, the size of the jar and a tendency for cleaning fluid to leak around the lid of the jar make use of the apparatus away from home less than desirable. Typically, a jar of cleaning fluid contains several ounces of fluid in a wide-mouth jar. Additionally, the lid must be opened every time it is desired to clean jewelry, which increases the likelihood of spilling cleaning fluid. In addition to possible leakage, the size of the jar generally makes it unsuitable for carrying in a pocket, purse, or other small travel bag.

SUMMARY OF THE INVENTION

In accordance with the present invention, a small, compact jewelry cleaning apparatus is provided that easily fits into a pocket or purse to allow a user to clean jewelry conveniently and thoroughly either at or away from home. The preferred apparatus includes a small container such as a bottle or cylinder containing a reservoir of cleaning fluid and a cleaning instrument, which preferably is attached to the container. The preferred apparatus further may include a magnifying lens for inspecting jewelry before and/or after cleaning. A dispensing pump preferably is provided in the container to emit either air and/or cleaning fluid. A brush may be provided as the cleaning instrument.

The preferred cleaning instrument comprises a short, narrow head and a handle extending from the head to enable the cleaning of jewelry. The cleaning instrument may be supported in a narrow channel incorporated into the sidewall of the container. A finger-engaging surface may be provided on the cleaning instrument to enable a user to slide the cleaning instrument from a retracted position, where the cleaning instrument is entirely within the channel, to an extended position, where the head is exposed and available for use. When not in use, the cleaning instrument preferably is stored in a retracted position within the narrow channel with the bristles facing inwardly so that any cleaning fluid remaining on the bristles does not damage other items being carried in the purse or pocket along with the apparatus. The magnifying lens preferably is provided as part of a cap for the apparatus to enable accessible viewing of the jewelry before and/or after cleaning.

In an alternate embodiment, the container may comprise an inner reservoir, in which the cleaning fluid is stored, and an outer sleeve, which surrounds the reservoir and which may define a space therebetween. A cleaning instrument may be secured between the container and the tube. The cleaning instrument may be slidable between a retracted position, where the cleaning instrument is entirely within the space between the reservoir and sleeve, and an extended position, where the cleaning instrument is exposed for use.

The preferred method for cleaning jewelry using the apparatus involves applying cleaning fluid contained in the container to a piece of jewelry, such as a ring, earrings, pendant, brooch, watch, or other item. A dispensing pump with an external actuator may be used with the container so that cleaning fluid and/or air may be sprayed on the jewelry. Following application of cleaning fluid, the cleaning instrument is used to remove foreign matter from the jewelry. After cleaning, the jewelry may be dried by blowing air onto the jewelry with the pump, or by use of a cloth or other means, and the jewelry then may be inspected using the magnifying lens. Any of these steps may be repeated as necessary.

Accordingly, it is a general object of the present invention to provide a compact portable jewelry cleaning apparatus suitable for personal transport such as in a purse, pocket, or travel bag.

Another object of the present invention is to provide a method for cleaning jewelry with cleaning fluid using a small apparatus suitable for carrying in a purse, pocket, or travel bag.

Further objects and features of the present invention will become apparent from the following description and the accompanying drawings.

DETAILED DESCRIPTION OF THE PREFERRED EMBODIMENT

Figure 2:
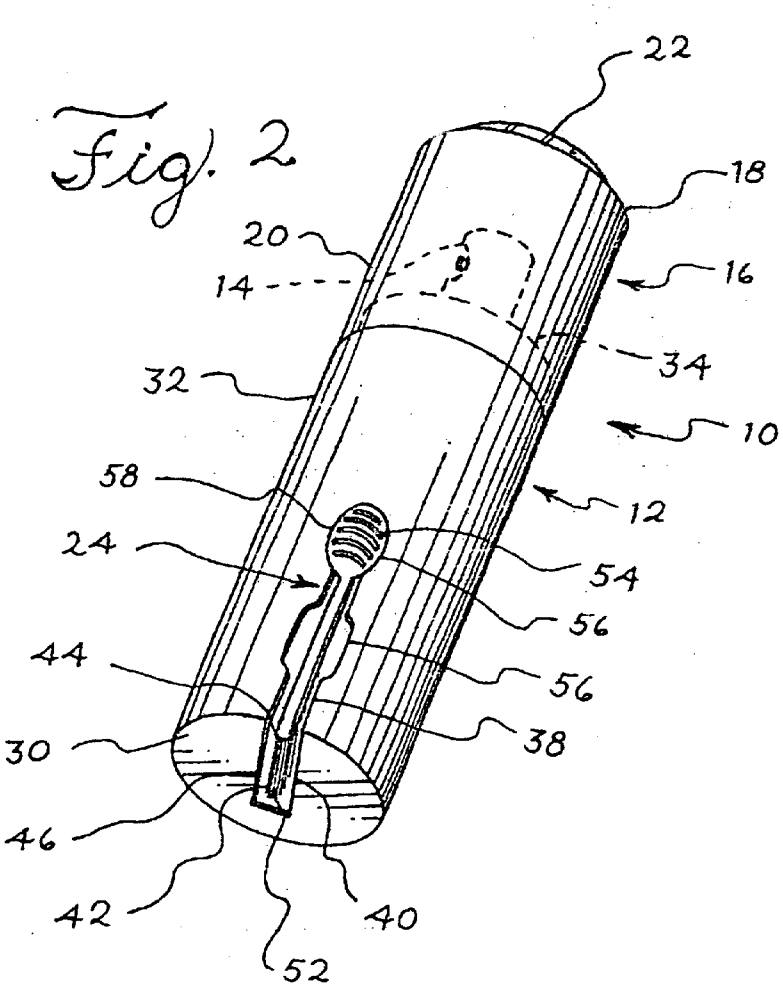
FIG. 2 is a second perspective view of the apparatus of FIG. 1, showing the cleaning instrument in its retracted position.
Figure 1:
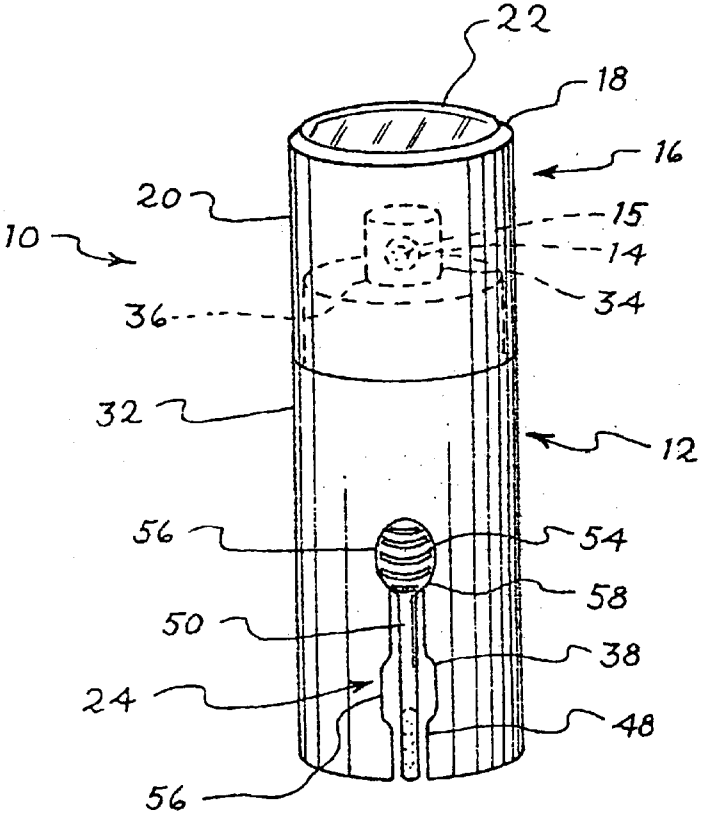
FIG. 1 is a perspective view of apparatus in accordance with an embodiment of the present invention, illustrating the apparatus when not in use.

As shown in FIGS. 1 and 2, the present invention generally is embodied in a jewelry cleaning apparatus 10 suitable for transport in a purse, pocket, or travel bag. The apparatus 10 provides a small, compact kit that allows a user to clean pieces of jewelry using cleaning fluid either at or away from home with a minimal amount of mess. In the preferred embodiment, a small container 12 such as a spray bottle, cylinder, or the like, contains a reservoir of cleaning fluid and an internal dispensing pump with an external actuator 14. The actuator preferably comprises a conventional push-button spray device having a small opening 15 that will emit air and/or cleaning fluid when depressed. A removable cap 16 having a top 18 and a generally cylindrical sidewall 20 extending downward from the top 18 covers the actuator 14. A magnifying lens 22 for inspecting the jewelry preferably is part of the cap 16. Additionally, the apparatus 10 comprises a cleaning instrument 24 for removing foreign matter from jewelry.

For convenience of description, terms such as "upward", "downward", "front", "back", etc., are used herein, referring to the apparatus 10 in an orientation as illustrated in FIG. 1. It should be understood that these terms are used only to indicate the relationship between various parts and that the apparatus 10 may be used in various different positions.

Figure 3:
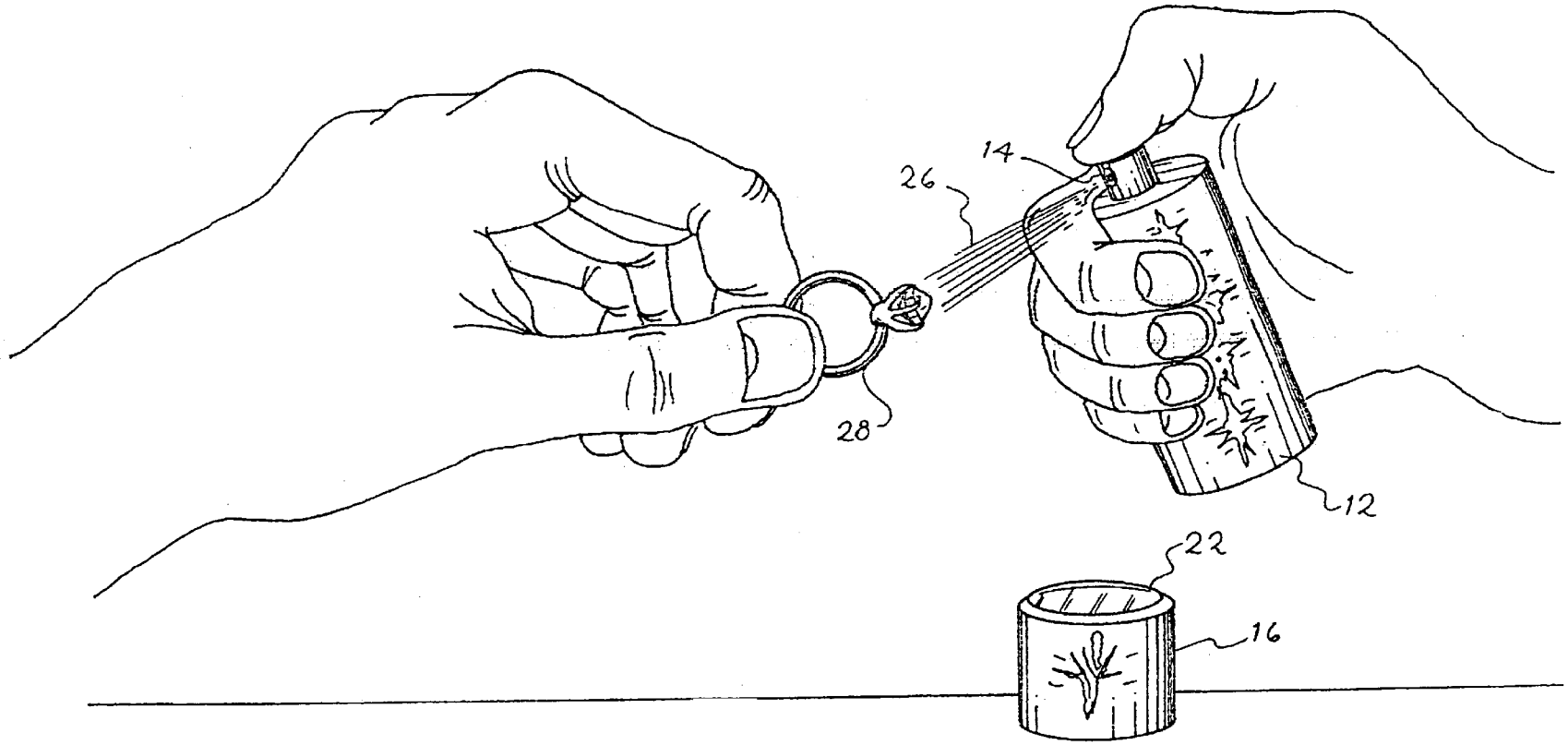
FIG. 3 is a perspective view of the apparatus of FIG. 1, illustrating a spraying operation.

In the preferred embodiment, the container 12 has an internal dispensing pump to emit a spray 26 of the cleaning fluid and/or air on a piece of jewelry 28, as illustrated in FIG. 3. The pump has a vertically reciprocating actuator 14 that is movable between an upper and a lower position. The actuator 14 should be biased toward the upper position such that it is sealed when in the upper position. An amount of solution to dissolve or loosen foreign matter on the surface of the jewelry 28 may be sprayed by depressing the actuator 14 beyond a predetermined point. The pump also preferably is capable of emitting air alone under some conditions. To this end, the pump is preferably constructed such that if the user depresses the actuator 14 only partially, the pump will emit air alone. A user may spray air on the jewelry 28 before application of cleaning fluid to blow dust or other dry particulates from the jewelry 28 or after cleaning to assist with drying the jewelry 28. In other embodiments, alternatives to the above-described pump may be employed, e.g., a pump which emits only cleaning fluid, or a conventional aerosol spray arrangement in which the fluid reservoir is pre-pressurized and the actuator simply opens and closes a valve.

The illustrated container 12 has a generally circular base 30, a generally cylindrical sidewall 32 that extends upward from the base 30, and a top 34 having an opening 36 therein for discharge of fluid. The actuator 14 and/or the pump may extend through the opening 36.

The container 12 has a narrow, outwardly opening channel 38 in the sidewall 32 for receiving the cleaning instrument 24. The channel 38 is defined by a pair of substantially vertical walls 40 that extend inward from the container sidewall 32, and a substantially vertical inner wall 42. The channel 38 runs lengthwise from the base 30 of the container 12 to a point short of the top of the container 34. The width of the channel 38 preferably decreases outwardly in order to slidably retain the cleaning instrument 24 within the channel 38. Thus, the channel 38 has a narrower outer portion 44 and a wider inner portion 46.

The cleaning instrument 24 may be a brush or other similar instrument and preferably comprises a short, narrow head 48 with a handle 50 extending from the head 48. A plurality of bristles 52 are supported on only one side of the head 48. The cleaning instrument 24 preferably is slidably connected to the container 12 within the narrow channel 38, with the head 48 adjacent to the base 30 of the container 12, as illustrated in FIG. 2, when not in use.

A finger-engaging surface 54 on the backside of the cleaning instrument 24, facing outward from the container 12, enables a user to slide the cleaning instrument 24 between retracted and extended positions. The finger-engaging surface 54 preferably is made of a resilient material and has a three-dimensional pattern on its surface for positive engagement with the finger of a user. The channel 38 may be molded to provide widened portions or detents 56 or other features that will cooperate with an enlarged portion or boss 58, which is made of a resilient material, on the handle 50 of the cleaning instrument 24 to allow the cleaning instrument 24 to be locked into position along the channel 38 when either fully retracted or extended. The resilient material of the boss 58 compresses between the vertical walls 40 of the channel 38 as the cleaning instrument 24 slides between the retracted and extended positions and expands at the detents 56 to lock the cleaning instrument 24 into either the fully retracted or fully extended position.

Figure 4:
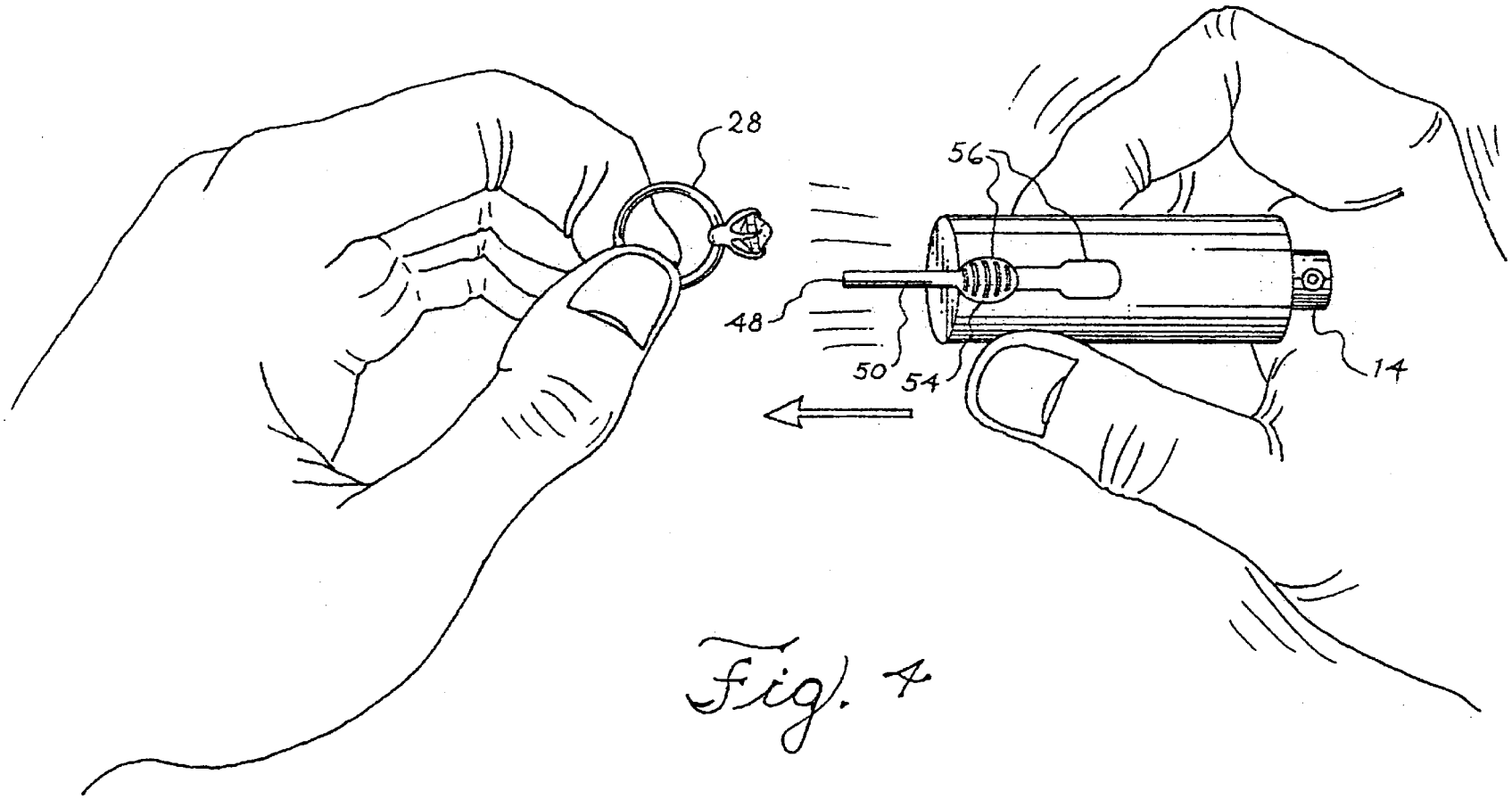
FIG. 4 is a perspective view of the apparatus of FIG. 1, illustrating the cleaning instrument in its extended position to clean jewelry.

When the cleaning instrument 24 is in the retracted position, it preferably is contained entirely within the channel 38 of the container 12 except that the finger-engaging surface 54 may protrude outward from the channel 38. The bristles 52 preferably face inwardly. The cleaning instrument 24 may be stored in this position when not being used so that any residual cleaning fluid on the bristles 52 does not contact any other items being carried along with the apparatus 10 in a purse, pocket or travel bag. When the cleaning instrument 24 is in the extended position, the head 48 is exposed below the base 30 of the container 12, and the bristles 52 are available for use. In the extended position, the container 12 may function as an additional length of handle for the cleaning instrument 24, as illustrated in FIG. 4. The user may grip the sidewall 20 of the container 12, instead of the handle 50 of the cleaning instrument 24, to facilitate better brushing movement when removing foreign matter from a piece of jewelry 28.

Figure 5:
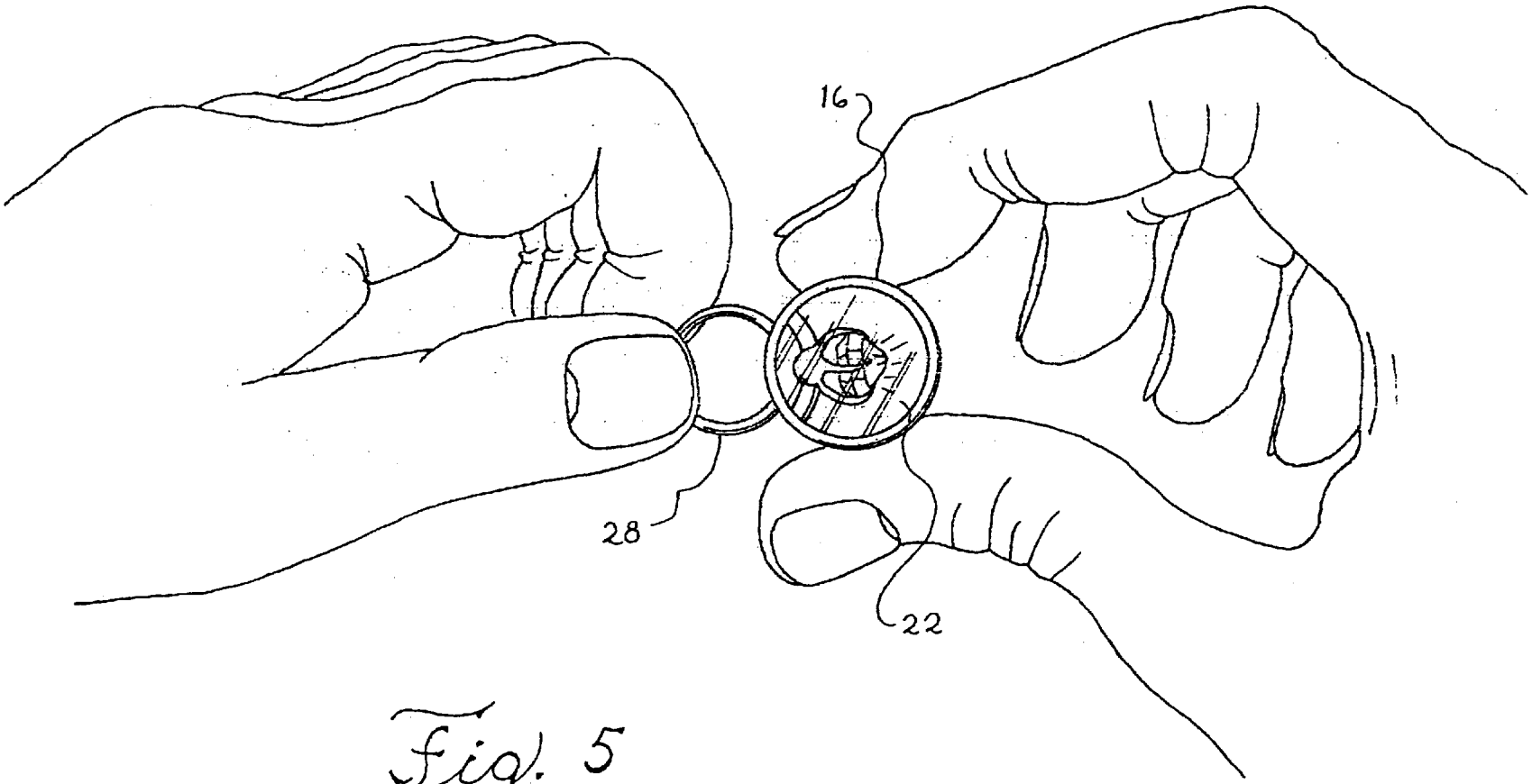
FIG. 5 is a perspective view of the apparatus of FIG. 1, illustrating inspection of a piece of jewelry with a magnifying lens.

In accordance with another feature of the preferred embodiment, the jewelry cleaning apparatus 10 also includes a magnifying lens 22. A user may view the jewelry 28 through the lens 22 before cleaning to inspect any foreign matter on the jewelry 28 or after cleaning to confirm that all foreign matter has been removed. The lens 22 preferably is part of the cap 16 for the container 12 and may be an integral part of the top 18 of the cap 16. Having the magnifying lens 22 as an integral part of the top 18 allows a user to grip the sidewall 20 of the cap 16, with the top 18 of the cap 16 facing toward him, in order to view objects through the magnifying lens 22, as illustrated in FIG. 5. With this configuration, the lens 22 is accessible for viewing jewelry 28 without obstructions from other features of the apparatus 10.

In a second embodiment of the invention, shown in FIGS. 6–10, there is provided an apparatus 100 which is identical to that of FIGS. 1–5 except as pointed out below. The apparatus 100 comprises a container 110 having an inner bottle or reservoir 112, and an outer sleeve 114. Cleaning fluid is contained within the reservoir 112, which includes an internal dispensing pump with an actuator 116 that will emit air and/or cleaning fluid. A removable cap 118 covers the actuator 116.

Figures 6, 7, 8:
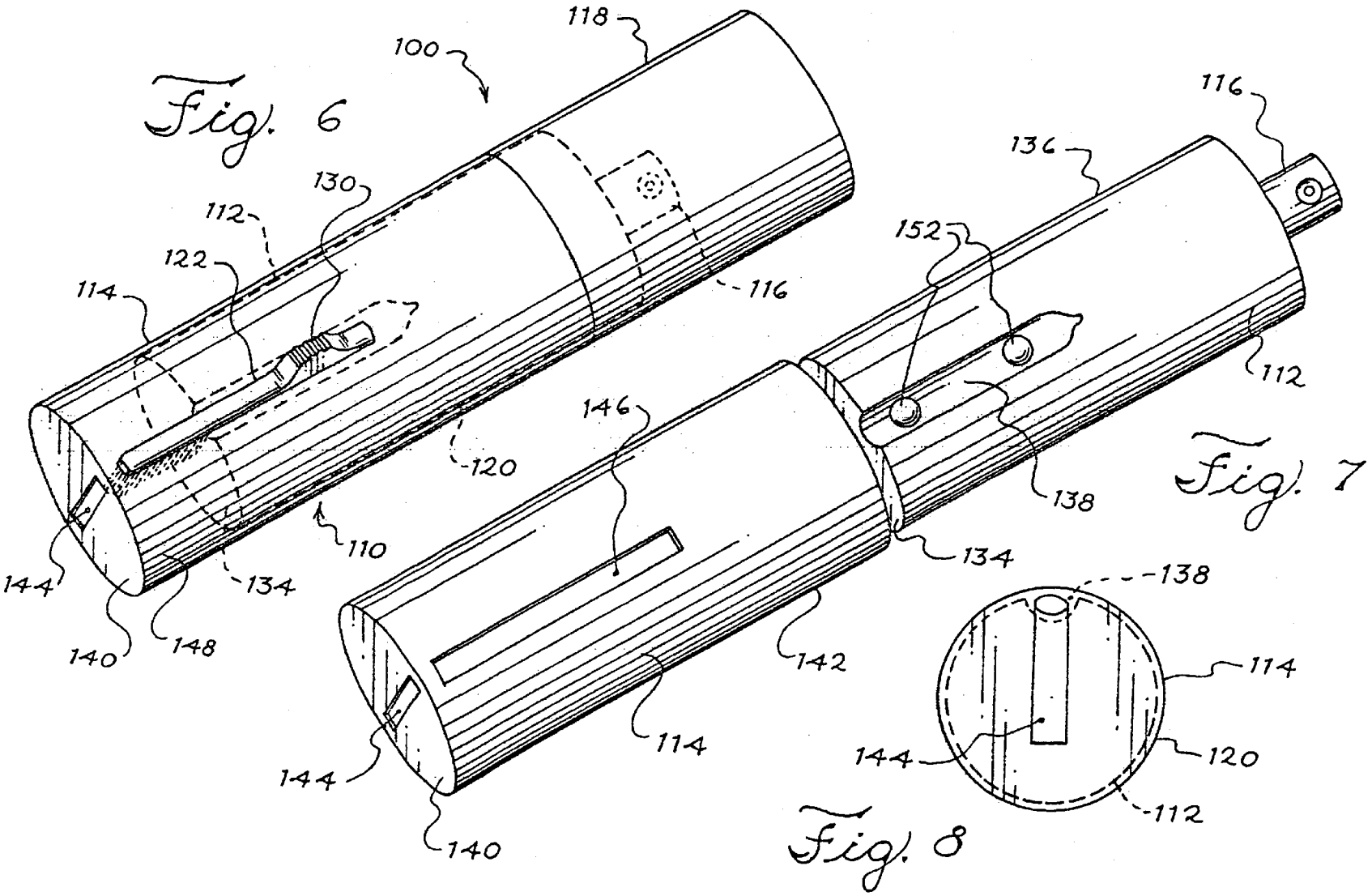
FIG. 6 is a perspective view of apparatus in accordance with a second embodiment of the invention illustrating the apparatus when not in use.
FIG. 7 is an exploded view of the apparatus of FIG. 6.
FIG. 8 is an end view of the apparatus of FIG. 6.
Figure 10:
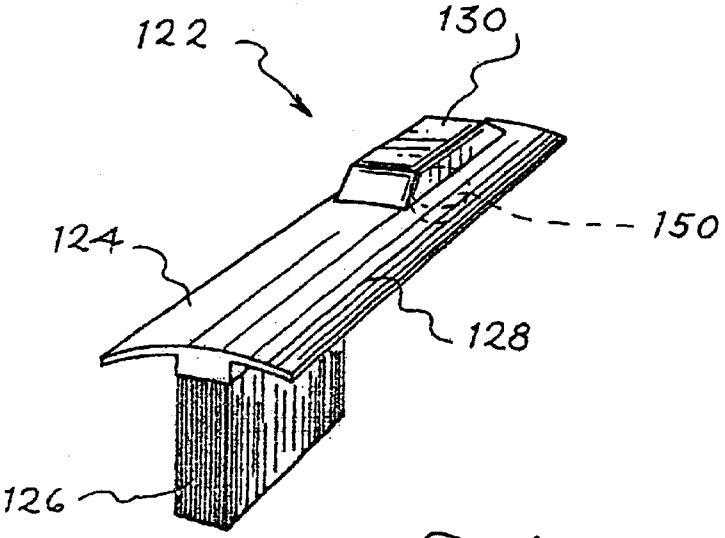
FIG. 10 is a second perspective view thereof.

The sleeve 114 is press fit onto the reservoir 112, and the reservoir has an elongated indentation therein creating a space 120 between the reservoir 112 and the sleeve 114 as shown in FIG. 8. A cleaning instrument 122 is secured between the reservoir 112 and the sleeve 114 within the space 120. The illustrated reservoir 112 has a generally circular base 134 and a generally cylindrical sidewall 136 that extends upward from the base 134. The sidewall 136 preferably has a narrow, outwardly opening channel 138 that runs lengthwise from the base 134 to a point short of the opposite end of the reservoir 112. The channel 138 accommodates the cleaning instrument 122. The illustrated sleeve 114 has a generally circular base 140 and a generally cylindrical sidewall 142 that extends upward from the base 140. The sleeve 114 preferably has an opening 144 at the base 140 and an opening 146 at the sidewall 142. In the illustrated embodiment, both openings 144 and 146 comprise generally rectangular slots. In other embodiments, openings of other shapes might be employed. Preferably, the sleeve 114 is longer than the reservoir 112 such that there is a gap 148 between the sleeve base 140 and the reservoir base 134.

Alternatively, in other embodiments, if the reservoir sidewall does not have a channel to accommodate the cleaning instrument, the sleeve sidewall may be noncircular so as to be spaced outward from the reservoir sidewall adjacent the opening to accommodate the cleaning instrument in the a space between the sleeve and the reservoir.

Figure 9:
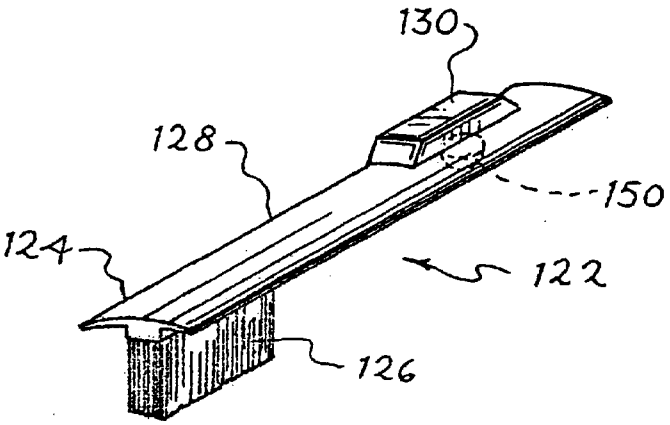
FIG. 9 is a perspective view of the cleaning instrument of the apparatus of FIG. 6.
Figure 11:
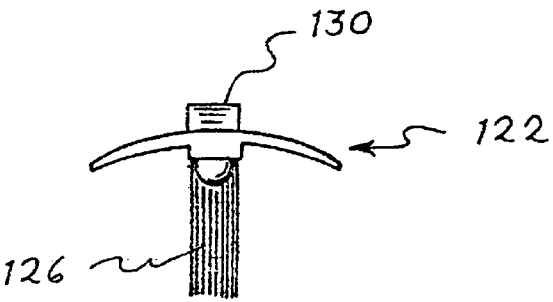
FIG. 11 is an end view thereof.

Preferably, the cleaning instrument 122 Icomprises a short, narrow head 124 having a plurality of bristles 126 supported on one side of the head 124 and a handle 128 extending from the head 124, as shown in FIG. 9. The cleaning instrument 122 is slidably secured in the space 120, with a finger-engaging surface 130 extending from the backside of the cleaning instrument 122 though the opening 146 in the sleeve 114 to enable a user to slide the cleaning instrument 122 between retracted and extended positions. Preferably, the bristles 126 face inwardly and, when in the retracted position, are contained entirely within the sleeve 114 in the gap 148. The head 124 extends through the opening 144 at the sleeve base 140 when in the extended position. A boss 150 extending from the handle 128 on the underside cooperates with notches 152 in the channel 138 to secure the cleaning instrument 122 in either the retracted or extended positions.

The preferred method for cleaning jewelry using the apparatus involves applying cleaning fluid contained in the container to a piece of jewelry, such as a ring, earrings, pendant, brooch, watch, or other item. A dispensing pump with an external actuator may be used with the container so that cleaning fluid and/or air may be sprayed on the jewelry. Following application of cleaning fluid, the cleaning instrument is used to remove foreign matter from the jewelry. After cleaning, the jewelry may be dried by blowing air onto the jewelry with the pump, or by use of a cloth or other means, and the jewelry then may be inspected using the magnifying lens. Any of these steps may be repeated as necessary.

From the foregoing, it should be appreciated that the invention provides a novel and useful jewelry cleaning apparatus. Although a preferred embodiment has been described above and illustrated in the accompanying drawings, there is no intent to limit the scope of the invention to this or any other particular embodiment. The invention is further described and pointed out by the following claims.

What is claimed is:

1. A small, compact jewelry cleaning apparatus suitable for carrying in a purse, pocket, or travel bag, the apparatus comprising:

a small container containing a reservoir of cleaning fluid, said container comprising a base, a sidewall extending upward therefrom, and a top;

a cleaning instrument comprising a head having a plurality of bristles supported on one side of said head and a handle extending from said head, said cleaning instrument being supported by said sidewall of said container;

said container including a dispensing pump remote from the cleaning instrument for application of cleaning fluid onto a piece of jewelry; and a magnifying lens removably supported on the container for inspecting a piece of jewelry before and after cleaning to detect foreign matter.

2. Apparatus in accordance with claim 1, wherein said dispensing pump includes an external actuator and said pump will emit air when said actuator is depressed to a first point and will emit stored cleaning fluid when said actuator is depressed to a second point beyond said first point.

3. Jewelry cleaning apparatus suitable for carrying about a user's person, the apparatus comprising:

a generally cylindrical container comprising a sleeve and a reservoir of cleaning fluid;

said reservoir having a base, a top and a generally cylindrical sidewall extending between said base and said top, said reservoir further having a channel incorporated lengthwise into said sidewall, said sleeve defining a hollow cavity receiving the reservoir base and at least a portion of the reservoir sidewall; and a cleaning instrument carried substantially entirely within said sleeve and in said channel, including a head slidably carried on said sleeve for movement generally parallel to the major axis of said cylindrical reservoir and a plurality of bristles extending at an angle from said head and said cleaning instrument disposed within said sleeve so as to avoid protruding therebeyond when in said retracted position.

4. Apparatus in accordance with claim 3, wherein said cleaning instrument is slidably mounted with respect to said container with the bristles facing inwardly within said sleeve when said cleaning instrument is in a retracted position and with the head being exposed and bristles available for use when the cleaning instrument is in an extended position, and wherein said cleaning instrument has a finger-engaging surface to facilitate sliding between positions.

5. Apparatus in accordance with claim 4 wherein said container functions as part of a handle for said cleaning instrument when said cleaning instrument is in the extended position.

6. Apparatus in accordance with claim 4, wherein said channel incorporated lengthwise into the sidewall of the reservoir runs from the base upward to a point short of the top.

7. Apparatus in accordance with claim 3, wherein said container includes a dispensing pump for application of cleaning fluid.

8. Apparatus in accordance with claim 7, wherein said dispensing pump includes an external actuator and said pump will emit air when said actuator is depressed to a first point and will emit stored cleaning fluid when said actuator is depressed to a second point beyond said first point.

* * * * *